US006261208B1

(12) United States Patent
Carson, Jr.

(10) Patent No.: US 6,261,208 B1
(45) Date of Patent: Jul. 17, 2001

(54) ROPE PULLING FRICTIONAL EXERCISE DEVICE

(76) Inventor: Murdock Carson, Jr., 126 Pineridge Rd., Daphne, AL (US) 36526

( * ) Notice: Subject to any disclaimer, the term of this patent is extended or adjusted under 35 U.S.C. 154(b) by 0 days.

(21) Appl. No.: 09/311,413

(22) Filed: May 13, 1999

(51) Int. Cl.[7] ..... A63B 7/04; A63B 21/018

(52) U.S. Cl. ..... 482/37; 482/51; 482/114; 482/120; 482/145

(58) Field of Search ..... 482/37, 51, 114, 482/115, 118–120, 145

(56) References Cited

U.S. PATENT DOCUMENTS

| | | | | |
|---|---|---|---|---|
| 641,519 | * | 1/1900 | Kerns | 482/119 |
| 3,451,271 | * | 6/1969 | Knoblauch | 482/113 |
| 3,498,608 | * | 3/1970 | Krug | 482/120 |
| 3,599,974 | * | 8/1971 | Price | 482/118 |
| 3,782,718 | * | 1/1974 | Saylor | 482/37 |
| 5,076,574 | * | 12/1991 | Johnson, Jr. | 482/37 |
| 5,380,258 | * | 1/1995 | Hawley, Jr. | 482/37 |
| 5,484,360 | * | 1/1996 | Haber et al. | 482/37 |
| 5,496,234 | * | 3/1996 | Sussich | 482/37 |
| 6,053,850 | * | 4/2000 | Martinez et al. | 482/118 |

FOREIGN PATENT DOCUMENTS

| | | | | |
|---|---|---|---|---|
| 2567028 | * | 1/1986 | (FR) | 482/37 |

* cited by examiner

*Primary Examiner*—Mickey Yu
*Assistant Examiner*—Victor K. Hwang

(57) ABSTRACT

A exercise device for exercising muscles of the upper body. The exercise device includes a generally U-shaped housing with a base portion adapted for resting on a floor, a main portion upwardly extending from a rear of the base portion, and an upper portion outwardly extending from an upper end of the housing. A pulley system is housed in the housing. A continuous rope extends through the pulley system and through holes in the upper and base portions of the housing. Movement of the rope is resisted by a friction member adjustably engaging portions of the rope wrapped about a cylindrical pulley.

9 Claims, 3 Drawing Sheets

ROPE PULLING FRICTIONAL EXERCISE DEVICE

BACKGROUND OF THE INVENTION

1. Field of the Invention

The present invention relates to exercise devices and more particularly pertains to a new exercise device for exercising muscles of the upper body.

2. Description of the Prior Art

The use of exercise devices is known in the prior art. More specifically, exercise devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,402,504; U.S. Pat. No. 5,626,546; U.S. Pat. No. 2,977,120; U.S. Pat. No. 4,666,151; U.S. Pat. No. 3,373,993; and U.S. Pat. No. Des. 254,143.

While these devices fulfill their respective, particular objectives and requirements, the aforementioned patents do not disclose a new exercise device. The inventive device includes a generally U-shaped housing with a base portion adapted for resting on a floor, a main portion upwardly extending from a rear of the base portion, and an upper portion outwardly extending from an upper end of the housing. A pulley system is housed in the housing. A continuous rope extends through the pulley system and through holes in the upper and base portions of the housing.

In these respects, the exercise device according to the present invention substantially departs from the conventional concepts and designs of the prior art, and in so doing provides an apparatus primarily developed for the purpose of exercising muscles of the upper body.

SUMMARY OF THE INVENTION

In view of the foregoing disadvantages inherent in the known types of exercise devices now present in the prior art, the present invention provides a new exercise device construction wherein the same can be utilized for exercising muscles of the upper body.

To attain this, the present invention generally comprises a generally U-shaped housing with a base portion adapted for resting on a floor, a main portion upwardly extending from a rear of the base portion, and an upper portion outwardly extending from an upper end of the housing. A pulley system is housed in the housing. A continuous rope extends through the pulley system and through holes in the upper and base portions of the housing.

It is therefore an object of the present invention to provide a new exercise device apparatus and method which has many of the advantages of the exercise devices mentioned heretofore and many novel features that result in a new exercise device which is not anticipated, rendered obvious, suggested, or even implied by any of the prior art exercise devices, either alone or in any combination thereof.

It is another object of the present invention to provide a new exercise device which may be easily and efficiently manufactured and marketed.

It is a further object of the present invention to provide a new exercise device which is of a durable and reliable construction.

An even further object of the present invention is to provide a new exercise device which is susceptible of a low cost of manufacture with regard to both materials and labor, and which accordingly is then susceptible of low prices of sale to the consuming public, thereby making such exercise device economically available to the buying public.

Still yet another object of the present invention is to provide a new exercise device which provides in the apparatuses and methods of the prior art some of the advantages thereof, while simultaneously overcoming some of the disadvantages normally associated therewith.

Still another object of the present invention is to provide a new exercise device for exercising muscles of the upper body.

Yet another object of the present invention is to provide a new exercise device which includes a generally U-shaped housing with a base portion adapted for resting on a floor, a main portion upwardly extending from a rear of the base portion, and an upper portion outwardly extending from an upper end of the housing. A pulley system is housed in the housing. A continuous rope extends through the pulley system and through holes in the upper and base portions of the housing.

Still yet another object of the present invention is to provide a new exercise device that stretches muscles of the upper body that dead weights and push ups don't.

These together with other objects of the invention, along with the various features of novelty which characterize the invention, arc pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
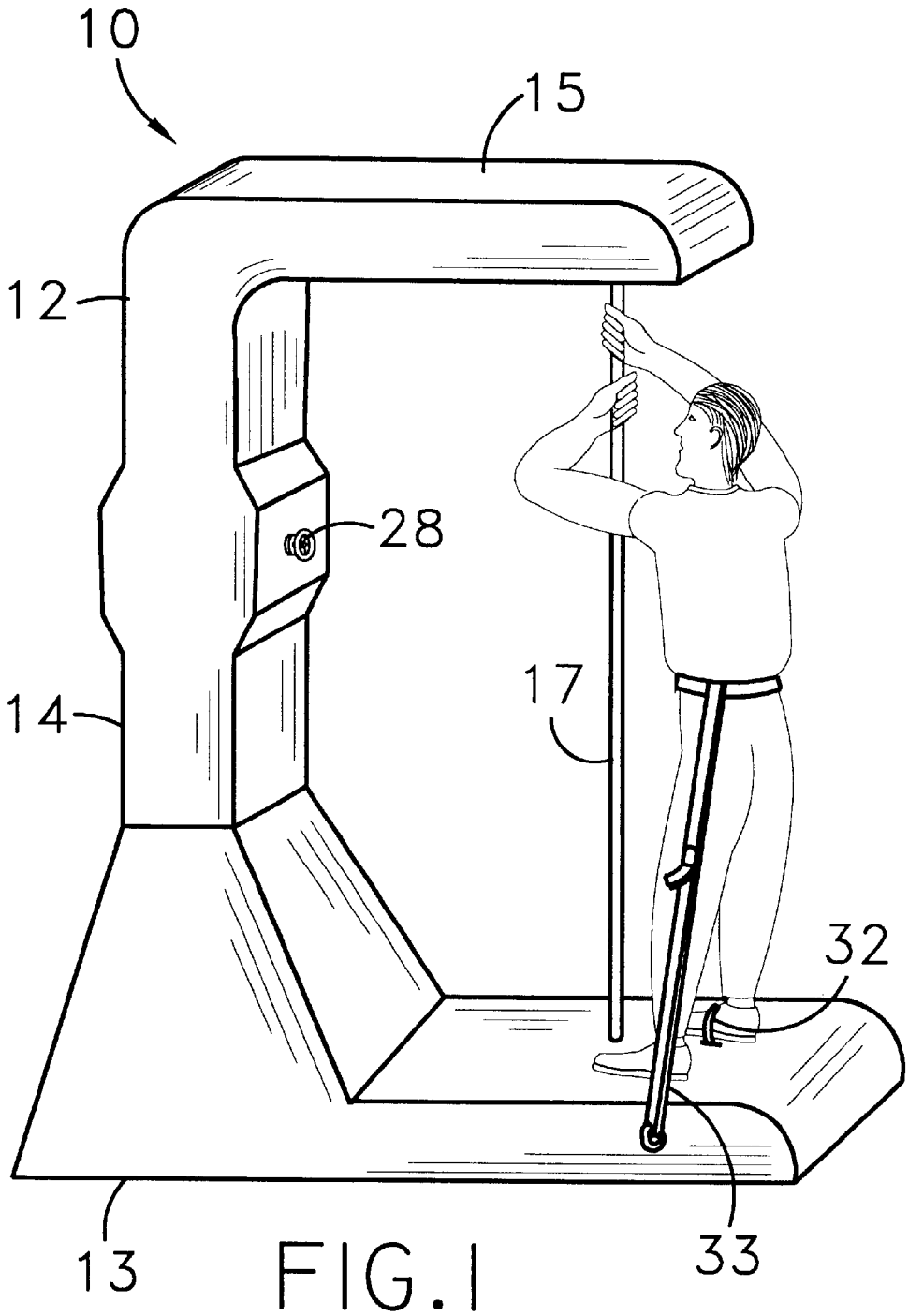
FIG. 1 is a schematic perspective view of a new exercise device according to the present invention.
Figure 2:
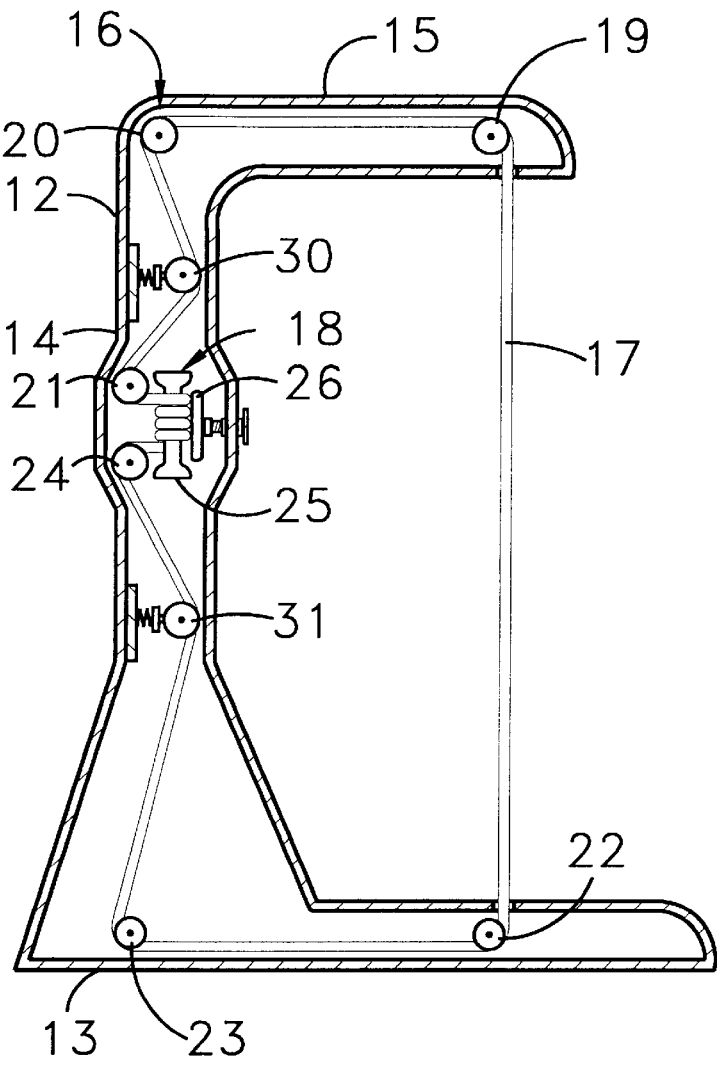
FIG. 2 is a schematic cross sectional view of the present invention.
Figure 6:
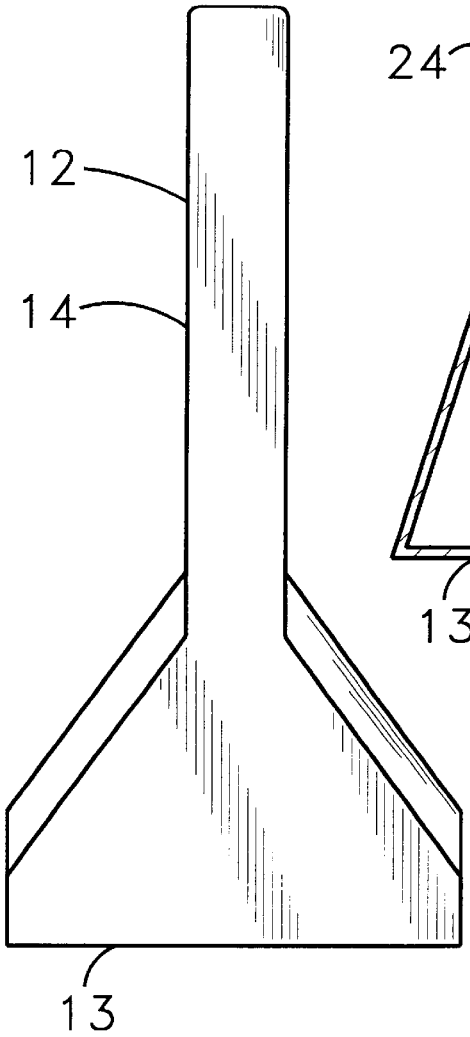
FIG. 6 is a schematic rear view of the present invention.
Figure 3:
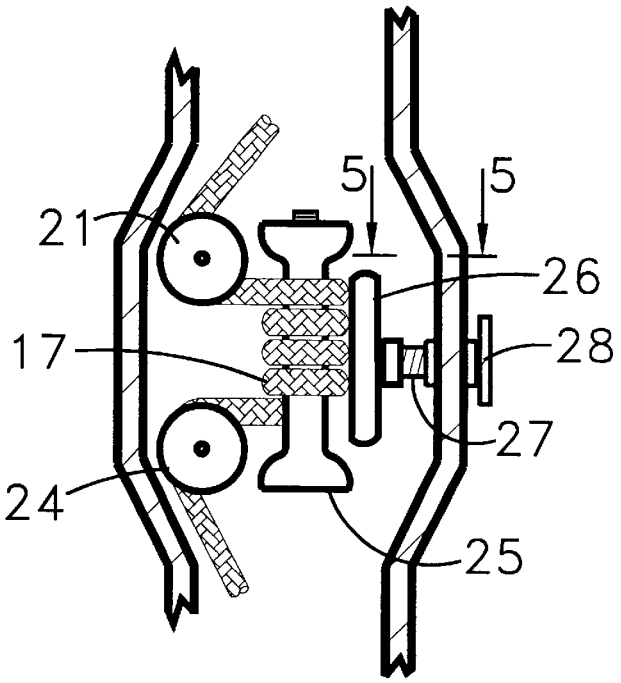
FIG. 3 is a schematic detailed view of the present invention.
Figure 4:
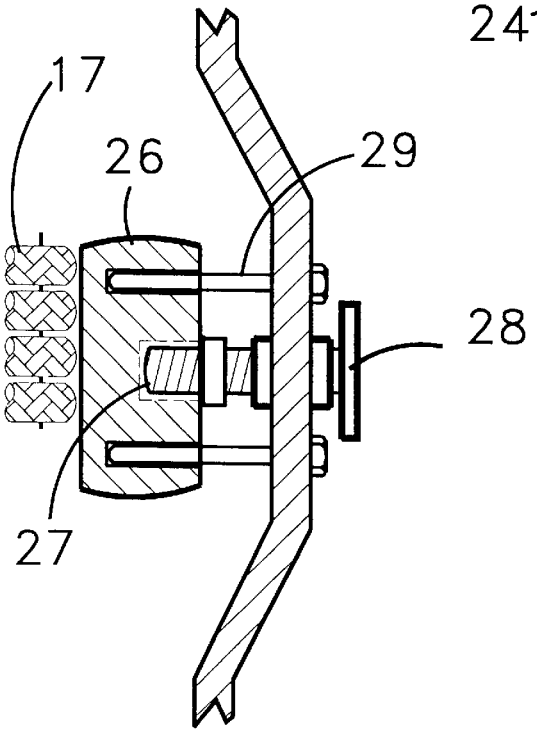
FIG. 4 is a schematic detailed view of the present invention.
Figure 5:
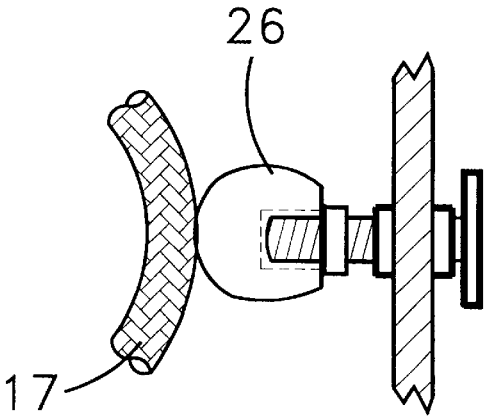
FIG. 5 is a schematic detailed view of the present invention taken from line 5—5 of FIG. 3.

With reference now to the drawings, and in particular to FIGS. 1 through 6 thereof, a new exercise device embodying the principles and concepts of the present invention and generally designated by the reference numeral 10 will be described.

As best illustrated in FIGS. 1 through 6, the exercise device 10 generally comprises a generally U-shaped housing 12 with a base portion 13 adapted for resting on a floor, a main portion 14 upwardly extending from a rear of the base portion, and an upper portion 15 outwardly extending from an upper end of the housing. A pulley system 16 is housed in the housing. A continuous rope 17 extends through the pulley system and through holes in the upper and base portions of the housing.

Preferably, the pulley system has a resistance portion 18 for selectively increasing and decreasing resistance of movement of the rope through the pulley system.

Also preferably, the pulley system has a first upper pulley 19 positioned towards the hole of the upper portion, a second upper pulley 20 positioned towards the upper end of the main portion of the housing, a third upper pulley 21 positioned towards the resistance portion, a first lower pulley 22 positioned towards the hole of the base portion, a second lower pulley 23 positioned towards a lower end of the main portion of the housing, and a third lower pulley 24 positioned towards the resistance portion.

Ideally, the resistance portion includes a cylindrical pulley 25 and a friction member 26 facing the cylindrical pulley. The rope is wrapped around the cylindrical pulley at least twice, ideally three times. The friction member frictionally engages the rope.

Most ideally, a threaded tightening shaft 27 extends through the main portion of the housing for selectively moving the resistance portion towards the cylindrical pulley for increasing the pressure of the friction member against the rope. See FIG. 4. An adjustment knob 28 is used to rotate the tightening shaft. A pair of guide pins 29 extend into cavities of the friction portion to prevent it from rotating. Ideally, the friction portion is rounded on the rope side.

A fourth upper pulley 30 may be positioned between the second and third upper pulleys. The fourth upper pulley is biased against the rope by a spring for increasing tension of the rope. Ideally, a fourth lower pulley 31 is positioned between the second and third lower pulleys. The fourth lower pulley is biased against the rope by a spring for increasing tension of the rope. Two pulleys are preferable in order to keep the rope tight when a user pulls on the rope.

Preferably, a pair of ankle straps 32 are coupled to an upper surface of the base portion of the housing adapted for coupling to feet of a user to hold the user down when pulling downwardly on the rope. Alternatively or in combination with the ankle straps, a pair of tic down straps 33 are adapted for coupling to a belt of a user to hold the user down when pulling downwardly on the rope. Ideally, the length of the tie down straps is adjustable. Optionally, the tie down straps may be elastic.

In use, a user stands on the base portion of the housing and pulls on the rope like the user is climbing the rope. The resistance portion may be used to increase resistance to movement of the rope through the pulley system by rotating the tightening shaft to push the friction portion against the rope.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rope pulling exercise device, comprising:

a generally U-shaped housing having a base portion adapted for resting on a floor, a main portion upwardly extended from a rear of the base portion, and an upper portion outwardly extending from an upper end for the housing;

a pulley system housed in said housing;

a continuous rope extending through said pulley system and through holes in said upper and base portions of said housing;

said pulley system having a resistance portion for selectively increasing and decreasing resistance of movement of said rope through said pulley system;

said resistance portion including a substantially cylindrical pulley and a friction member facing said cylindrical pulley, a portion of said rope being wrapped around said cylindrical pulley, said friction member frictionally abutting a portion of rope wrapped about said cylindrical pulley an upper biasing being biased against a portion of said rope above said cylindrical pulley for increasing tension of said rope;

a lower biasing pulley being biased against a portion of said rope below said cylindrical pulley for increasing tension of said rope; and a threaded tightening shaft extending through said main portion of said housing for selectively moving said friction member towards said pulley for increasing pressure applied by said friction member against said rope, said tightening shaft further comprising and adjustment knob, said knob being located on an exterior of said main portion of said housing for permitting adjustment of said tightening shaft while using said device.

2. The exercise device of claim 1, wherein said pulley system having a first upper pulley positioned adjacent said hole of said upper portion a second upper pulley positioned adjacent said upper end of said main portion of said housing, a third upper pulley positioned adjacent said resistance portion, a first lower pulley positioned adjacent said hole of said base portion, a second lower pulley positioned adjacent a lower end of said main portion of said housing, and a third lower pulley positioned towards said resistance portion.

3. The exercise device of claim 2, further comprising a pair of ankle straps coupled to an upper surface of said base portion of said housing adapted for coupling to feet of a user.

4. The exercise device of claim 2, further comprising a pair of tie down straps adapted for coupling to a belt of a user.

5. The exercise device of claim 2, wherein said friction member further comprises a pair of guide pins extending through said guide member for resisting rotation of said friction member.

6. The exercise device of claim 2, wherein said upper biasing pulley is biased against said rope by a spring for increasing tension of said rope.

7. The exercise device of claim 2, wherein said lower biasing pulley is biased against said rope by a spring for increasing said tension of said rope.

8. The exercise device of claim 2, wherein said rope is wrapped about said cylindrical pulley at least three times.

9. A rope pulling exercise device, comprising:

a generally U-shaped housing having a base portion adapted for resting on a floor, a main portion upwardly extending from a rear of the base portion, and an upper portion outwardly extending from an upper end of the housing;

a pulley system housed in said housing;

a continuous rope extending through said pulley system and through holes in said upper and base portions of said housing;

said pulley system having a resistance portion for selectively increasing and decreasing resistance of movement of said rope through said pulley system;

said pulley system having a first upper pulley positioned adjacent said hole of said upper portions, a second upper pulley portioned adjacent said upper and of said main portion of said housing, a third upper pulley positioned adjacent said resistance portion, a first lower pulley positioned adjacent said holes of said base portion, a second lower pullet positioned adjacent a lower and of said main portion of said housing, and third lower pulley positioned adjacent said resistance portion;

said resistance portion including a cylindrical pulley and a friction member facing said cylindrical pulley, said rope being wrapped around said cylindrical pulley, said friction member frictionally engaging said rope;

a threaded tightening shaft extending through said main portion of said housing for selectively moving said friction member towards said cylindrical pulley for increasing the pressure of said friction member against said rope;

a fourth upper pulley being portioned between said second and third upper pulleys, said fourth upper pulley being biased against said rope for increasing tension of said rope;

a fourth lower pulley being positioned between said second and third lower pulleys, and fourth lower pulley being biased against said rope for increasing tension of said rope;

a pair of ankle straps coupled to an upper surface of said base portion of said housing adapted for coupling to feet of a user; and a pair of tie down straps adapted for coupling to a belt of a user.

* * * * *